US005863683A

United States Patent [19]

Ohta et al.

[11] Patent Number: 5,863,683

[45] Date of Patent: Jan. 26, 1999

[54] ELECTROPHOTOGRAPHIC PHOTOCONDUCTOR CONTAINING CHARGE GENERATING AZO PIGMENT SUBJECTED TO A SALT-MILLING PROCESS

[75] Inventors: Katsuichi Ohta, Mishima; Masaomi Sasaki, Susono; Tamotsu Aruga, Mishima, all of Japan

[73] Assignee: Ricoh Company, Ltd., Tokyo, Japan

[21] Appl. No.: 724,010

[22] Filed: Sep. 30, 1996

Related U.S. Application Data

[63] Continuation of Ser. No. 453,827, May 30, 1995, abandoned, which is a continuation of Ser. No. 165,857, Dec. 14, 1993, abandoned.

[30] Foreign Application Priority Data

Dec. 14, 1992 [JP] Japan ..... 4-333039

[51] Int. Cl.[6] ..... G03G 5/06

[52] U.S. Cl. ..... 430/58; 430/135; 430/72; 430/78; 430/56

[58] Field of Search ..... 430/135, 136, 430/58, 78, 72, 56

[56] References Cited

U.S. PATENT DOCUMENTS

| | | | |
|---|---|---|---|
| 4,904,557 | 2/1990 | Kubo | 430/58 |
| 4,980,254 | 12/1990 | Hiro | 430/135 |
| 5,055,368 | 10/1991 | Nguyen et al. | 430/78 |
| 5,066,796 | 11/1991 | Law | 430/78 |
| 5,077,161 | 12/1991 | Law | 430/78 |
| 5,141,837 | 8/1992 | Nguyen et al. | 430/135 |
| 5,238,766 | 8/1993 | Molaire et al. | 430/78 |
| 5,274,084 | 12/1993 | Miyamoto et al. | 430/78 |

*Primary Examiner*—Christopher D. Rodee
*Attorney, Agent, or Firm*—Oblon, Spivak, McClelland, Maier & Neustadt, P.C

[57] ABSTRACT

An electrophotographic photoconductor composed of an electroconductive support and a photoconductive layer formed thereon, which contains as a charge generating material an azo pigment subjected to a salt milling process.

14 Claims, 2 Drawing Sheets

ELECTROPHOTOGRAPHIC PHOTOCONDUCTOR CONTAINING CHARGE GENERATING AZO PIGMENT SUBJECTED TO A SALT-MILLING PROCESS

This application is a Continuation of application Ser. No. 08/453,827, filed on May 30, 1995, now abandoned, which is a Continuation of application Ser. No. 08/165,857, filed on Dec. 14, 1993, abandoned.

BACKGROUND OF THE INVENTION

1. Field of the Invention

The present invention relates to an electrophotographic photoconductor, and more particularly to an electrophotographic photoconductor having sensitivities in the broad wavelength range from a visible region to a near infrared region.

2. Discussion of Background

Recent development of information processing systems utilizing electrophotography is remarkable. In particular, a photoprinter which converts information to be recorded into digital signals and optically records the information is excellent in the printing quality and operational reliability. This digital recording technology is applied not only to such a photoprinter, but also to ordinary copying machines, so that a so-called digital copying machine has been developed.

A copying machine which employs the conventional analog copying technology, as well as this digital recording technology, can be provided with various information processing functions, so that it is expected that a demand for such a copying machine will be increased.

At present, semiconductor diodes (LD) and light emitting diodes (LED), which are small sized and inexpensive and have high operational reliability, are in general use as light sources for the optical printer. However, the wavelength of the light emitted from LED now in general use is 660 nm, while the wavelength range of the light emitted from LD is in a near infrared region, so that the development of an electrophotographic photoconductor having sensitivities in the range from a visible region to a near infrared region is desired.

The photosensitive wavelength range of an electrophotographic photoconductor is substantially determined by the photosensitive wavelength range of a charge generating material (CGM) employed in the electrophotographic photoconductor, so that varieties of charge generating materials such as an azo pigment, a polycyclic quinone pigment, a trigonal system selenium and a phthalocyanine pigment have been developed.

Of the above-mentioned charge generating materials, many kinds of azo pigments have been developed because of the facility of the synthesis reaction thereof, and the diversification in the chemical structures thereof.

For instance, a bisazo pigment having a diphenylpolyene skeleton as disclosed in Japanese Laid-Open Patent Applications 64-79753, 59-129857 and 62-267363, and Japanese Patent Publications 3-34503 and 4-52459; and a trisazo pigment as disclosed in Japanese Laid-Open Patent Application 57-195767 can serve as the charge generating materials which have high photosensitivities in a broad wavelength range from visible through near infrared and are capable of surely retaining the charging potential. However, the photosensitivities of the above-mentioned azo pigments are not enough to cope with the trend toward small-size, high-speed information processing apparatus.

An electrophotographic photoconductor comprising a titanyl phthalocyanine pigment subjected to a dry salt milling process is proposed in U.S. Pat. No. 5,055,368. Although such a phthalocyanine pigment has sufficiently high photosensitivity in a broad photosensitive wavelength range, the crystalline form of the pigment is readily changed depending on the kind of organic solvent used in the preparation of the photoconductor. The quality stability of the phthalocyanine pigment as the charge generating material is therefore considered to be poor. In addition, the retention stability of the charging potential of the above phthalocyanine pigment is poorer than that of the conventional azo pigment.

As previously mentioned, a charge generating material (CGM) having a high photosensitivity in a broad wavelength range from visible through near infrared has not yet been developed.

SUMMARY OF THE INVENTION

It is therefore an object of the present invention to provide an electrophotographic photoconductor which has sufficiently high photosensitivity in a broad photosensitive wavelength range from visible through near infrared, and stable charging characteristics.

The above-mentioned object of the present invention can be achieved by an electrophotographic photoconductor comprising an electroconductive support and a photoconductive layer formed thereon which comprises as a charge generating material an azo pigment subjected to a salt milling process.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

It has been found that the photosensitivity of an electrophotographic photoconductor comprising as the CGM an azo pigment subjected to a so-called salt milling process is remarkably improved when compared with the case where the azo pigment not subjected to the salt milling process is contained in the photoconductor.

Figure 1A:
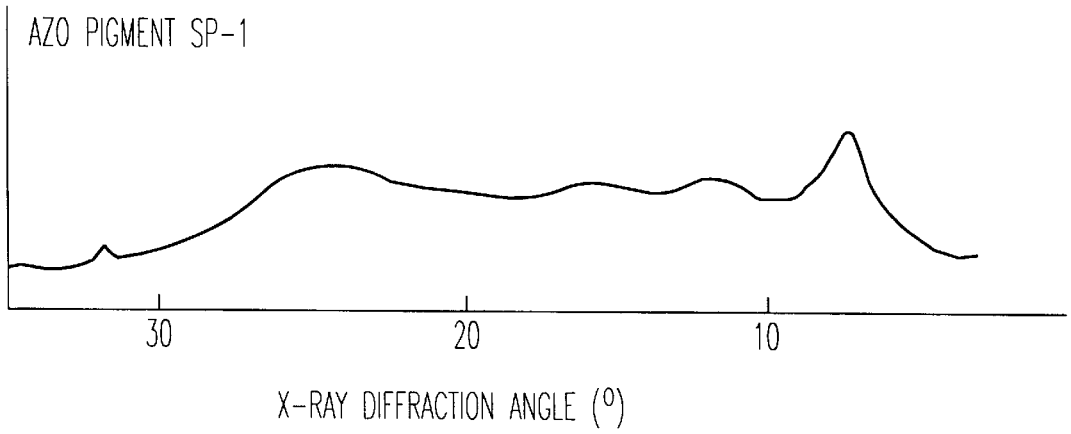
FIGS. 1A and 1B are graphs which show the X-ray diffraction patterns of an azo pigment used in Example 1 before and after the salt milling process.
Figure 1B:
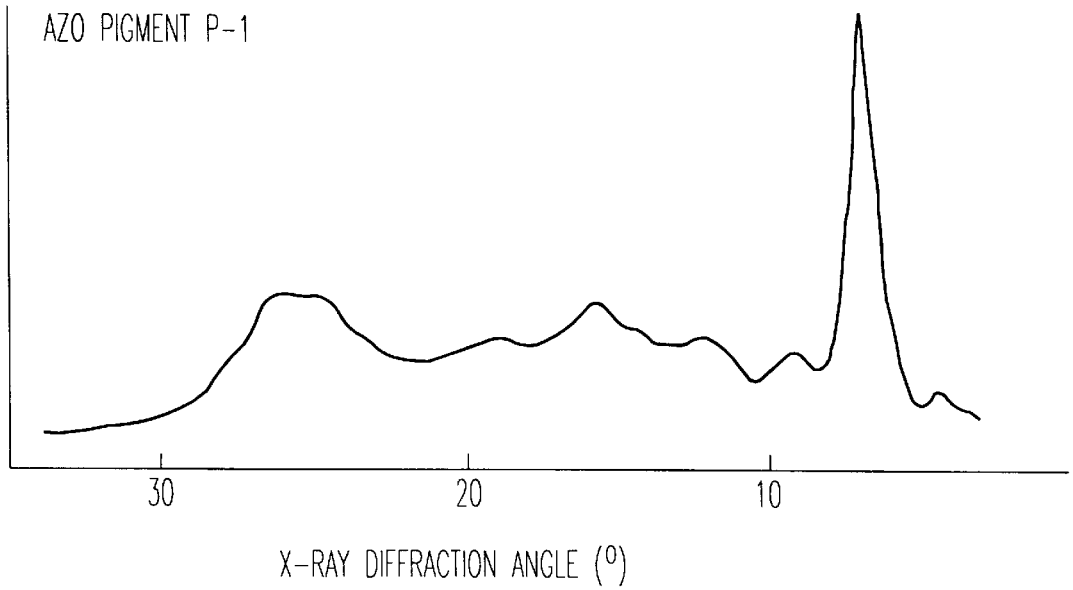

As can be seen from the graphs shown in FIGS. 1A and 1B, a peak in the X-ray diffraction pattern of an azo pigment (SP-1) subjected to the salt milling process is lower than that of an azo pigment (P-1) not subjected to the salt milling process. It is supposed that the state of the azo pigment (SP-1) subjected to the salt milling process is changed to an amorphous state, or the crystals of the pigment become small. The accurate mechanism of this sensitizing effect on the azo pigment has not been clarified.

The salt milling process for use in the present invention is carried out in such a manner that crude crystals of an azo pigment and a salt such as NaCl, KCl, KBr, or $CH_3COONa$ are put in the same container and the mixture is subjected to milling by the application of the strong mechanical energy of compression, shearing, grinding, rubbing, stretching, impact and shaking to the mixture at the same time.

Any means that is capable of grinding the mixture with the application of the strong mechanical energy of compression, shearing, grinding, rubbing, stretching, impact and shaking to the mixture of the azo pigment and the salt for use in the present invention is available in the salt milling process. For example, a ball mill, an oscillating mill, a disk-shaped oscillating mill, an attritor, a sand mill, a paint shaker and a jet-mill can be employed in the present invention.

The conventional milling member for general use, such as balls made of steel, stainless steel, partially-stabilized zirconia (PSZ), agate and glass, and sand particles can be employed in the mill.

In the present invention, inorganic salts and organic salts can be used in the salt milling process. Specific examples of the inorganic salt for use in the salt milling process include an alkali metal halide, carbonate, sulfate, and phosphate, such as NaCl, KCl, KBr, $Na_2SO_4$, $K_2SO_4$, and $CaCO_3$. As the organic salt, for example, $CH_3COONa$ can be employed. The inorganic or organic salt with a cation such as $Na^+$ or $K^+$ is preferably employed in the salt milling process.

According to the salt milling process for use in the present invention, an azo pigment and a salt are put in the same container together with the above-mentioned milling member, and the milling of the mixture is performed for a predetermined time. The optimal quantity of the salt, which varies depending upon the amount and the kind of azo pigment to be subjected to the salt milling process, the size of the milling apparatus, and the processing time, is preferably equivalent to the pigment, up to 1,000 times that of the azo pigment.

After the completion of the milling, the azo pigment is separated from the salt and the milling member, for example, in such a manner that the salt is dissolved in an appropriate solvent followed by filtration or centrifugation. Water, alcohols such as methanol and ethanol, ketones such as acetone and methyl ethyl ketone, ethyl acetate and ethylene glycol, and mixed solvents thereof can be used as the solvents for dissolving the salt therein. After the separation of the azo pigment from the salt and the milling member, the solvent component is removed from the azo pigment by drying under application of heat thereto or under reduced pressure.

Besides the above-mentioned dry-type salt milling process, a solvent salt milling process is usable in the present invention. By the solvent salt milling process the mixture of the azo pigment and the salt is subjected to milling in the presence of an organic solvent in which the salt to be employed is only slightly soluble. The sensitizing effect on the azo pigment is further improved by the salt milling in the presence of the organic solvent.

Any organic solvent in which the salt to be employed is slightly soluble may be employed in the solvent salt milling process. Specific examples of the organic solvent for use in the solvent salt milling process are methanol, ethanol, propanol, butanol, acetone, methyl ethyl ketone, methyl isobutyl ketone, cyclohexanone, tetrahydrofuran, cyclohexane, toluene, xylene, methyl cellosolve, ethyl cellosolve, dichloromethane, 1,2-dichloroethylene, 1,1,2-trichloroethylene, and mixed solvents of the above solvents.

When the solvent salt milling process is carried out, the azo pigment, the salt, the milling member and the organic solvent are placed in the milling container to perform the milling for a predetermined time. After the completion of the milling, the organic solvent and the salt are removed from the mixture, and then the azo pigment is dried.

Preferable examples of the azo pigment for use in the electrophotographic photoconductor according to the present invention include a trisazo pigment represented by formula (I):

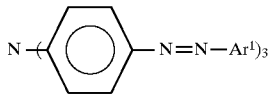

(I)

wherein $Ar^1$ is a coupler residual group; and a bisazo pigment represented by formula (II):

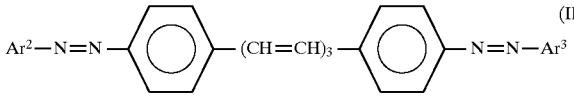

(II)

wherein $Ar^2$ and $Ar^3$ each is a coupler residual group; and 1 is An integer of 1 to 6.

Examples of the coupler residual group represented by $Ar^1$, $Ar^2$ and $Ar^3$ in formulas (I) and (II) include:

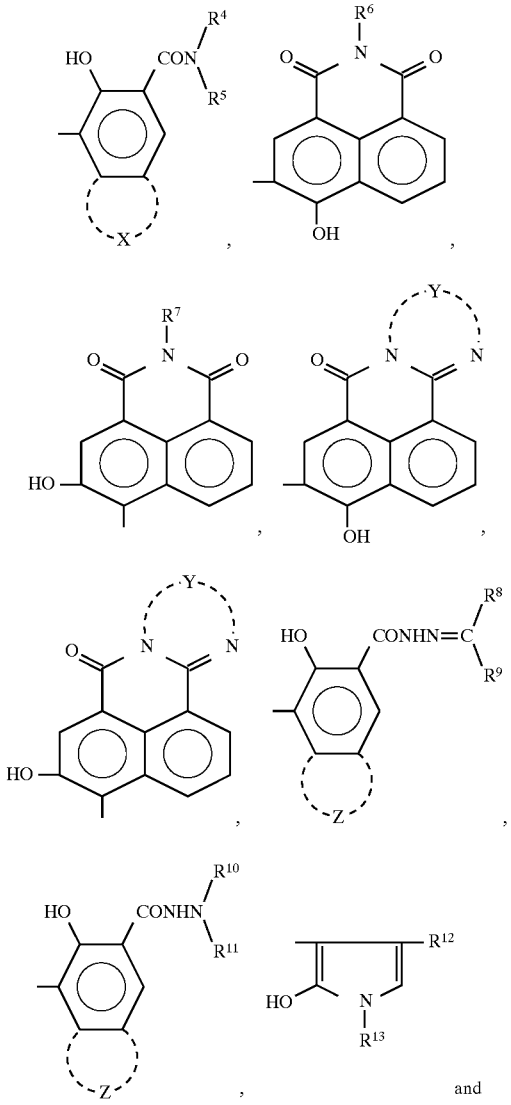

and

-continued

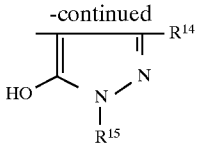

wherein X is a residual group necessary for forming in combination with a benzene ring a polycyclic aromatic ring selected from the group consisting of a naphthalene ring, anthracene ring, carbazole ring, benzocarbazole ring, dibenzofuran ring and dibenzothiophene ring, or a hetero ring; $R^4$ and $R^5$ each is hydrogen, an alkyl group which may have a substituent, an aryl group or a heterocyclic group, and $R^4$ and $R^5$ may form a ring together with the bonding nitrogen atom; $R^6$ and $R^7$ each is an alkyl group which may have a substituent, or an aryl group; Y is a bivalent aromatic hydrocarbon group or a bivalent heterocyclic group including nitrogen therein; $R^8$, $R^9$, $R^{10}$ and $R^{11}$ each is hydrogen, an alkyl group which may have a substituent, an aralkyl group, an aryl group, or a heterocyclic group, and $R^{10}$ and $R^{11}$ may form a five- or six-membered ring which may include a condensed aromatic ring; Z is a residual group necessary for forming in combination with a benzene ring a polycyclic aromatic ring selected from the group consisting of a naphthalene ring, anthracene ring, carbazole ring, benzocarbazole ring, dibenzofuran ring and dibenzothiophene ring, or a hetero ring; $R^{13}$ and $R^{15}$ each is an aromatic ring such as a benzene ring or a naphthalene ring, each of which may have a substituent; and $R^{12}$ and $R^{14}$ each is hydrogen, a lower alkyl group, or carboxyl group and esters thereof.

An electrophotographic photoconductor according to the present invention comprises as the charge generating material the previously mentioned azo pigment subjected to the salt milling process. The preparation method of this electrophotographic photoconductor will now be described in detail.

A photoconductive layer of the electrophotographic photoconductor according to the present invention may be either of a dispersion type or of a function-separated type by use of a charge generating material and a charge transporting material in combination.

In the case of the dispersion type, a dispersion prepared by dispersing a charge generating material and a charge transporting material in a binder resin is applied to an electroconductive support to form a photoconductive layer thereon.

In the case of the function-separated type, a charge generation layer comprising a charge generating material and a binder resin is provided on an electroconductive support, and a charge transport layer comprising the charge transporting material and a binder resin is then provided on the charge generation layer. When a function-separated type electrophotographic photoconductor for positive charging is fabricated, the charge transport layer may be first provided on the electroconductive support and the charge generation layer is then provided on the charge transport layer. In the function-separated type electrophotographic photoconductor, the charge transporting material can be incorporated into the charge generation layer. In this case, the photosensitivity of the photoconductor for positive charging can be particularly improved.

In order to improve the adhesion and charge blocking properties of the photoconductor, an intermediate layer may be interposed between the electroconductive support and the photoconductive layer. Furthermore, a protective layer may be provided on the photoconductive layer in order to improve the resistance to wear and the mechanical durability of the photoconductive layer.

As the binder agent for use in the charge generation layer and the charge transport layer of the function-separated type electrophotographic photoconductor, and for use in the photoconductive layer of the dispersion type electrophotographic photoconductor of the present invention, any binder agents with excellent insulating properties which are conventionally employed in electrophotographic photoconductors can be employed.

Examples of such binder agents include polycarbonates (bisphenol A type and bisphenol Z type), polyester, methacrylic resin, acrylic resin, polyethylene, polyvinyl chloride, polyvinyl acetate, polystyrene, phenolic resin, epoxy resin, polyurethane, polyvinylidene chloride, alkyd resin, silicone resin, polyvinyl carbazole, polyvinyl butyral, polyvinyl formal, polyacrylate, polyacrylamide, polyamide and phenoxy resin. These binder agents can be used alone or in combination.

In the case of a negative-charging type photoconductor comprising an electroconductive support, and a charge generation layer and a charge transport layer, which are successively overlaid on the electroconductive support in this order, it is preferable that the ratio by weight of the charge generating material to the binder agent be (20 or more):100 in the charge generation layer, and that the thickness of the charge generation layer be in the range of 0.01 to 5 $\mu$m. It is preferable that the ratio by weight of the charge transporting material to the binder agent be in the range from (20:100) to (200:100) in the charge transport layer, and that the thickness of the charge transport layer be 5 to 100 $\mu$m.

In the case of a positive-charging type photoconductor comprising an electroconductive support, and a charge transport layer and a charge generation layer, which are successively overlaid on the electroconductive support in this order, it is preferable that the ratio by weight of the charge generating material to the binder resin be (20 or more):100 in the charge generation layer. Moreover, it is preferable to incorporate the charge transporting material into the charge generation layer, so that the increase of the residual potential can be minimized and the photosensitivity can be enhanced. In this case, it is preferable that the ratio by weight of the charge transporting material incorporated into the charge generation layer to the binder resin therein be in the range from (20:100) to (200:100).

In the case of the dispersion type electrophotographic photoconductor, it is preferable that the ratio by weight of the azo pigment subjected to the salt milling process serving as a charge generating material to the binder agent be in the range from (5:100) to (95:100) in the photoconductive layer, and that the thickness of the photoconductive layer be in the range of 10 to 100 $\mu$m. In addition, it is preferable that the ratio by weight of the charge transporting material to the binder agent be in the range from (30:100) to (200:100) in the photoconductive layer.

Moreover, in order to improve the chargeability and the gas resistance of the photoconductive layer for use in the present invention, an antioxidant such as a phenolic compound, a hydroquinone compound, a hindered phenolic compound, a hindered amine compound, or a compound including hindered amine and hindered phenol within the molecules thereof can be added to the photoconductive layer of the electrophotographic photoconductor of the present invention regardless of the type thereof.

As the electroconductive support for the electrophotographic photoconductor of the present invention, a film, a cylindrical film, a belt-shaped film and a sheet of paper, on which an electroconductive material with a volume resistivity of $10^{10}$ Ω·cm or less is deposited or coated by vacuum deposition or sputtering can be employed. Examples of such an electroconductive material are metals such as aluminum, nickel, chromium, nichrome, copper, silver, gold, and platinum; metallic oxides such as indium oxide; and copper iodide.

Furthermore, as the electroconductive support, a plate, a belt, and a base drum made of aluminum, aluminum alloy, nickel, or stainless steel can be employed. In particular, the base drum can be made by producing a tube by drawing and ironing (D.I.), impact ironing (I.I.), extrusion, or pultrusion, and then subjecting the tube to cutting, superfinishing and abrasion.

In addition to the above, for instance, a plastic plate coated with an appropriate resin in which electroconductive finely-divided particles of carbon black, indium oxide or tin oxide are dispersed can also be used as the electroconductive support.

Any of conventionally known charge transporting materials can be employed as the charge transporting material for use in the present invention.

For example, a compound having a basic structure of formula (III) as disclosed in Japanese Laid-Open Patent Application 1-302260 can be used as the CTM:

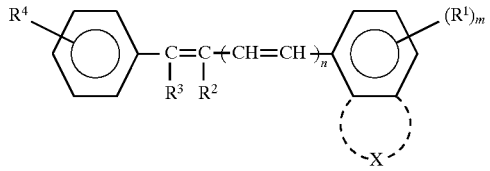

(III)

wherein $R^1$ and $R^4$ each is hydrogen, an alkyl group, an alkoxyl group, a halogen atom, or a substituted amino group; $R^2$ and $R^3$ each is hydrogen, an alkyl group or a substituted or unsubstituted phenyl group;

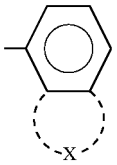

represents a benzene ring, a naphthalene ring, an anthracene ring, an indole ring or a carbazole ring; n is an integer of 0 or 1; and m is an integer of 0, 1, 2 or 3.

Specific examples of the compound of formula (III) are as shown in Table 1.

TABLE 1

| Charge Transporting Material No. | n | $R^2$ | $R^3$ | $R^4$ | 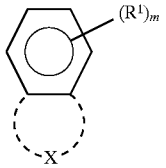 |
|---|---|---|---|---|---|
| III-1 | 0 | H | 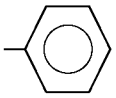 | H | 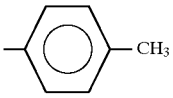 |
| III-2 | 0 | H | 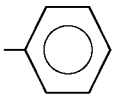 | H | 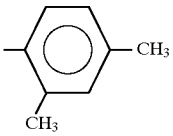 |
| III-3 | 0 | H | 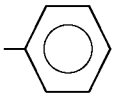 | H | 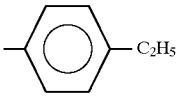 |
| III-4 | 0 | H | 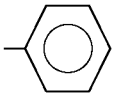 | H | 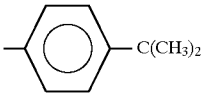 |
| III-5 | 0 | H | 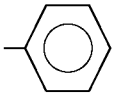 | H | 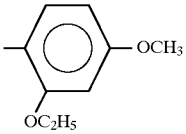 |
| III-6 | 0 | H | 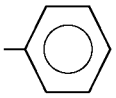 | H | 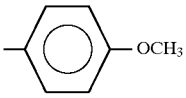 |

TABLE 1-continued
| Charge Transporting Material No. | n | $R^2$ | $R^3$ | $R^4$ | 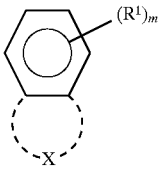 |
|---|---|---|---|---|---|
| III-7 | 0 | H | 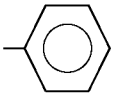 | H | 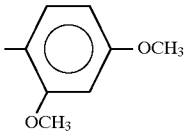 |
| III-8 | 0 | H | 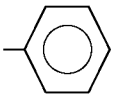 | H | 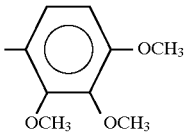 |
| III-9 | 0 | H | 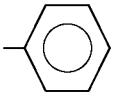 | H | 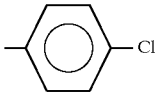 |
| III-10 | 0 | H | 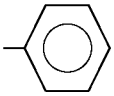 | H | 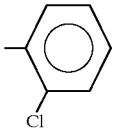 |
| III-11 | 0 | H | 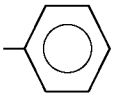 | H | 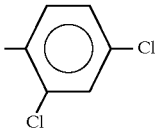 |
| III-12 | 0 | H | 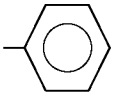 | H | 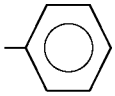 |
| III-13 | 0 | H | 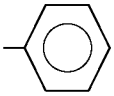 | H | 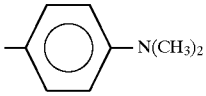 |
| III-14 | 0 | H | 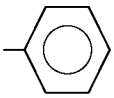 | H | 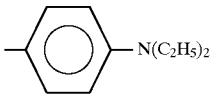 |
| III-15 | 0 | H | 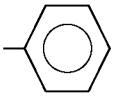 | H | 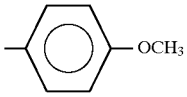 |
| III-16 | 0 | H | 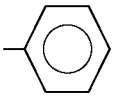 | H | 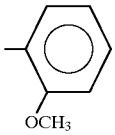 |
| III-17 | 0 | H | 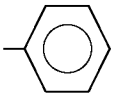 | H | 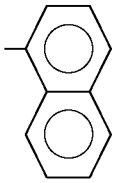 |

TABLE 1-continued
| Charge Transporting Material No. | n | $R^2$ | $R^3$ | $R^4$ | 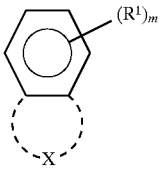 |
|---|---|---|---|---|---|
| III-18 | 0 | H | 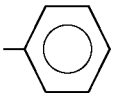 | H | 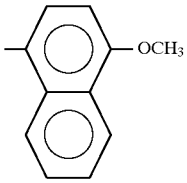 |
| III-19 | 0 | H | 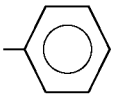 | H | 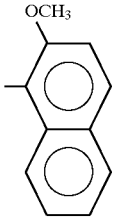 |
| III-20 | 0 | H | 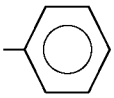 | H | 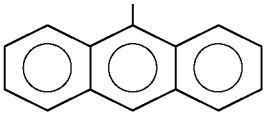 |
| III-21 | 0 | H | 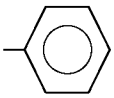 | H | 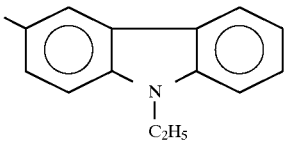 |
| III-22 | 0 | H | 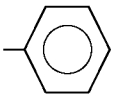 | H | 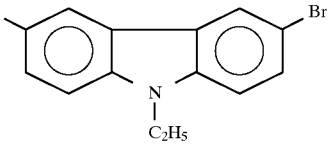 |
| III-23 | 0 | H | 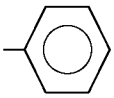 | H | 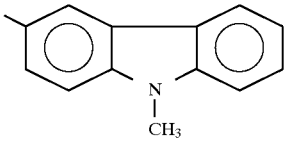 |
| III-24 | 0 | H | 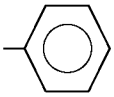 | H | 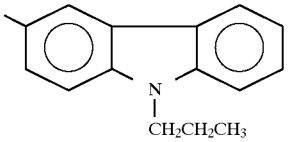 |
| III-25 | 0 | H | 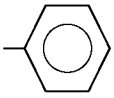 | H | 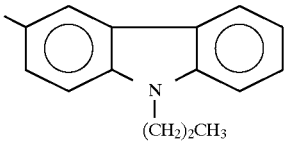 |
| III-26 | 0 | 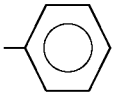 | 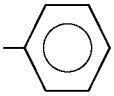 | H | 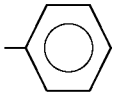 |

TABLE 1-continued
| Charge Transporting Material No. | n | $R^2$ | $R^3$ | $R^4$ | 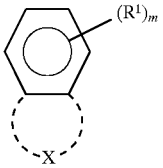 |
|---|---|---|---|---|---|
| III-27 | 0 | 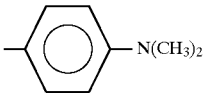 | 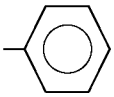 | H | 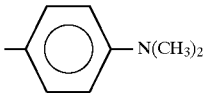 |
| III-28 | 0 | 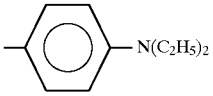 | 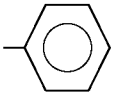 | H | 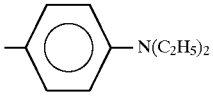 |
| III-29 | 0 | H | 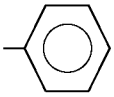 | H | 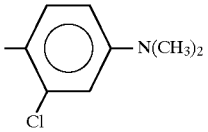 |
| III-30 | 0 | H | 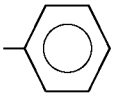 | H | 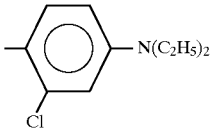 |
| III-31 | 0 | H | 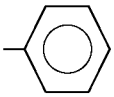 | H | 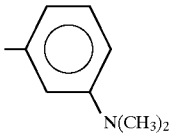 |
| III-32 | 0 | H | 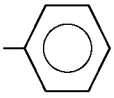 | H | 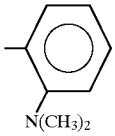 |
| III-33 | 0 | $-CH_3$ | 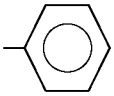 | H | 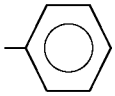 |
| III-34 | 0 | $-CH_3$ | 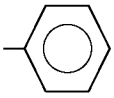 | H | 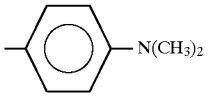 |
| III-35 | 0 | H | 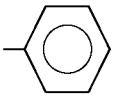 | H | 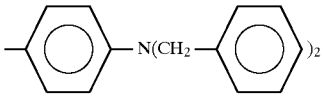 |
| III-36 | 0 | H | 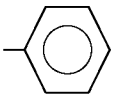 | H | 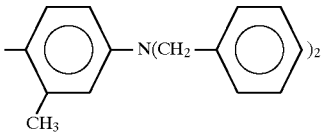 |
| III-37 | 0 | H | 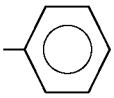 | H | 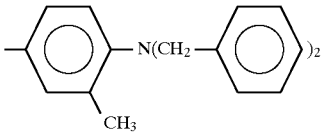 |

TABLE 1-continued
| Charge Transporting Material No. | n | $R^2$ | $R^3$ | $R^4$ | 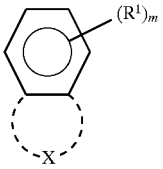 |
|---|---|---|---|---|---|
| III-38 | 0 | H | 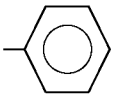 | H | 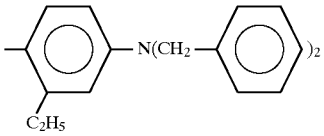 |
| III-39 | 0 | H | 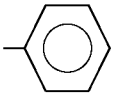 | H | 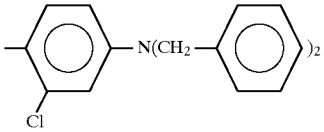 |
| III-40 | 0 | H | 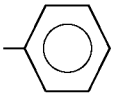 | H | 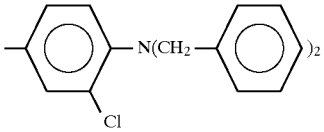 |
| III-41 | 0 | H | 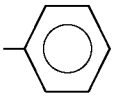 | H | 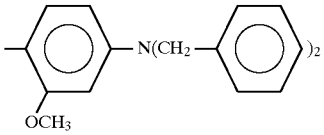 |
| III-42 | 0 | H | 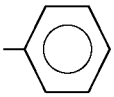 | H | 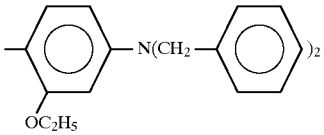 |
| III-43 | 0 | H | 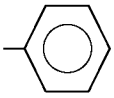 | H | 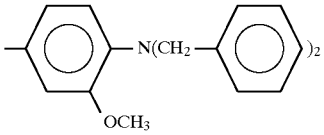 |
| III-44 | 0 | H | 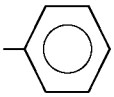 | H | 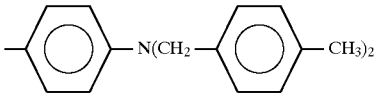 |
| III-45 | 0 | H | 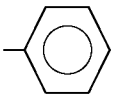 | H | 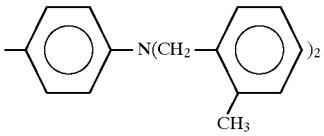 |
| III-46 | 0 | H | 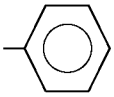 | H | 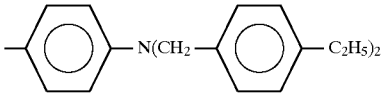 |
| III-47 | 0 | H | 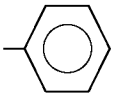 | H | 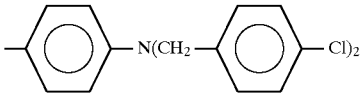 |

TABLE 1-continued
| Charge Transporting Material No. | n | $R^2$ | $R^3$ | $R^4$ | 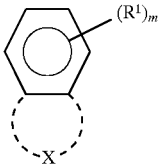 |
|---|---|---|---|---|---|
| III-48 | 0 | H | 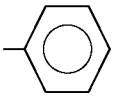 | H | 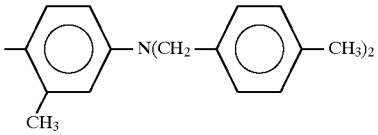 |
| III-49 | 0 | H | 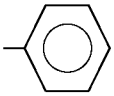 | H | 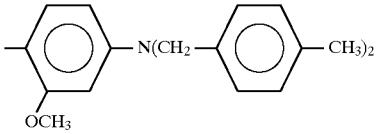 |
| III-50 | 0 | H | 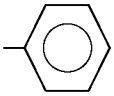 | H | 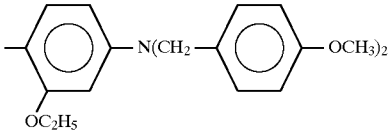 |
| III-51 | 0 | H | 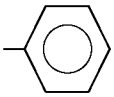 | H | 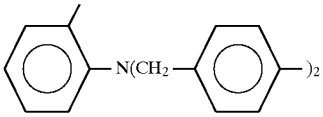 |
| III-52 | 0 | H | 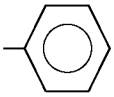 | H | 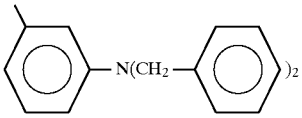 |
| III-53 | 0 | H | 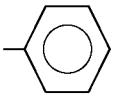 | H | 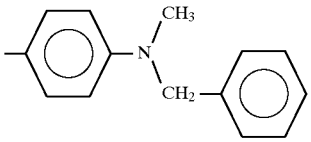 |
| III-54 | 0 | H | 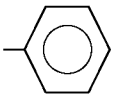 | H | 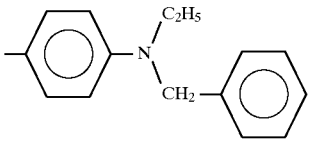 |
| III-55 | 0 | H | 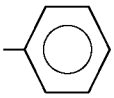 | H | 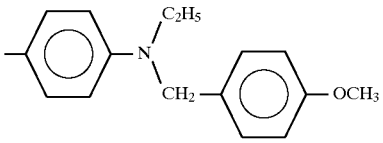 |
| III-56 | 0 | H | 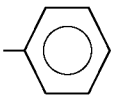 | H | 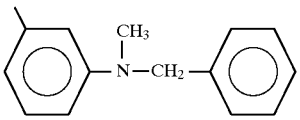 |
| III-57 | 0 | H | 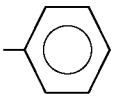 | H | 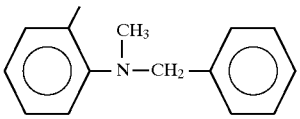 |

TABLE 1-continued
| Charge Transporting Material No. | n | $R^2$ | $R^3$ | $R^4$ | 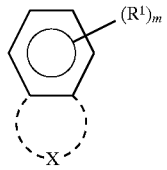 |
|---|---|---|---|---|---|
| III-58 | 0 | H | 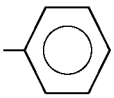 | H | 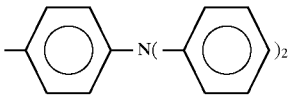 |
| III-59 | 0 | H | 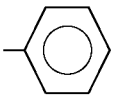 | H | 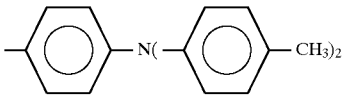 |
| III-60 | 0 | H | 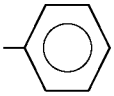 | H | 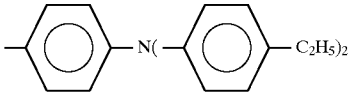 |
| III-61 | 0 | H | 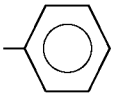 | H | 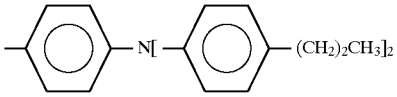 |
| III-62 | 0 | H | 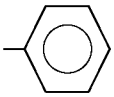 | H | 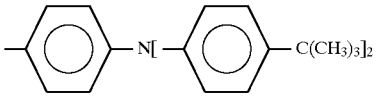 |
| III-63 | 0 | H | 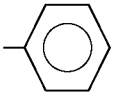 | H | 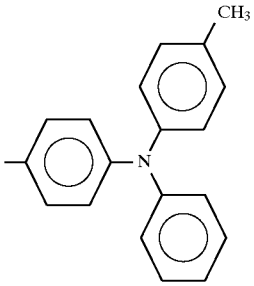 |
| III-64 | 0 | H | 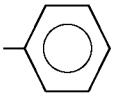 | H | 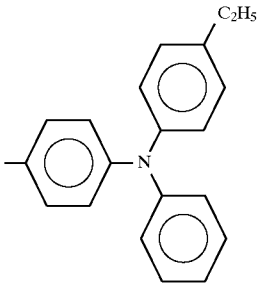 |
| III-65 | 0 | H | 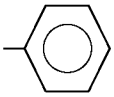 | H | 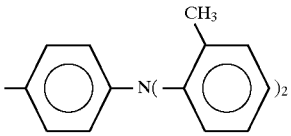 |
| III-66 | 0 | H | 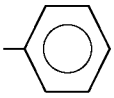 | H | 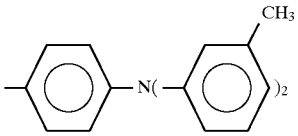 |

TABLE 1-continued
| Charge Transporting Material No. | n | $R^2$ | $R^3$ | $R^4$ | 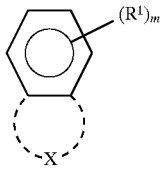 |
|---|---|---|---|---|---|
| III-67 | 0 | H | 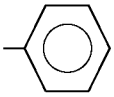 | H | 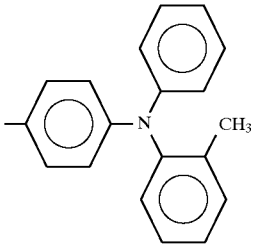 |
| III-68 | 0 | H | 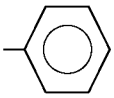 | H | 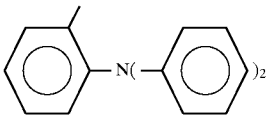 |
| III-69 | 0 | H | 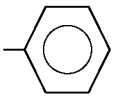 | H | 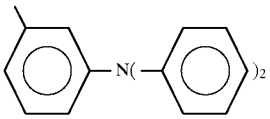 |
| III-70 | 0 | H | 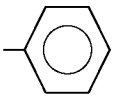 | H | 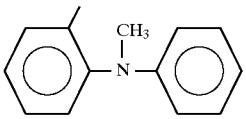 |
| III-71 | 0 | H | 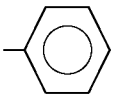 | H | 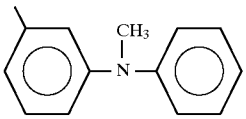 |
| III-72 | 0 | H | 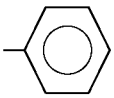 | H | 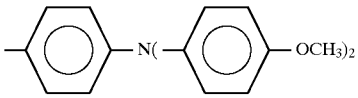 |
| III-73 | 0 | H | 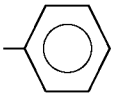 | H | 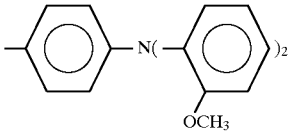 |
| III-74 | 0 | H | 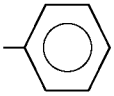 | H | 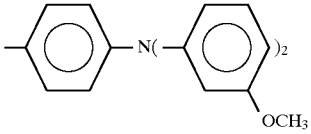 |
| III-75 | 0 | H | 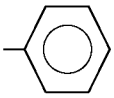 | H | 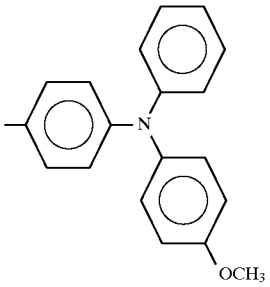 |

TABLE 1-continued
| Charge Transporting Material No. | n | $R^2$ | $R^3$ | $R^4$ | 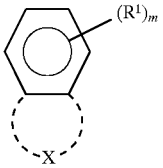 |
|---|---|---|---|---|---|
| III-76 | 0 | H | 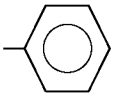 | H | 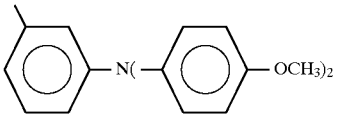 |
| III-77 | 0 | H | 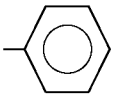 | H | 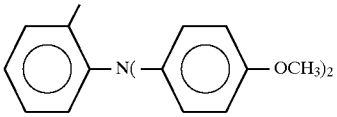 |
| III-78 | 0 | H | 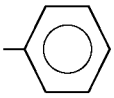 | H | 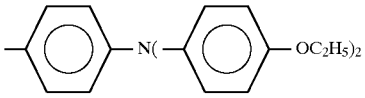 |
| III-79 | 0 | H | 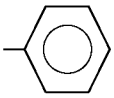 | H | 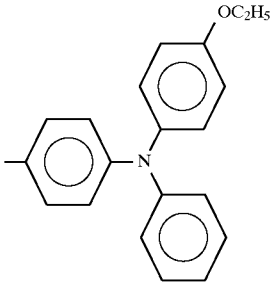 |
| III-80 | 0 | H | 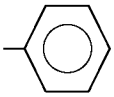 | H | 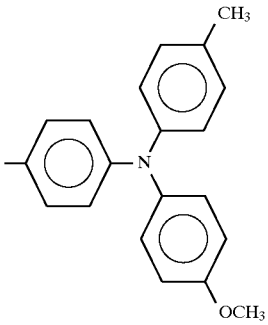 |
| III-81 | 0 | H | 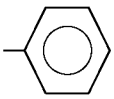 | H | 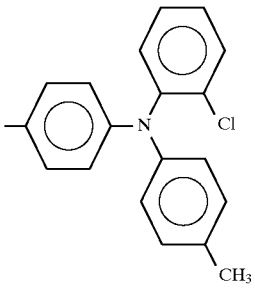 |
| III-82 | 0 | H | 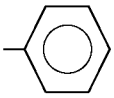 | H | 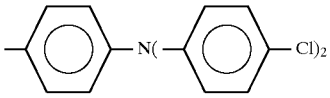 |

TABLE 1-continued
| Charge Transporting Material No. | n | $R^2$ | $R^3$ | $R^4$ | 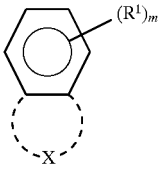 |
|---|---|---|---|---|---|
| III-83 | 0 | H | 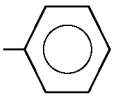 | H | 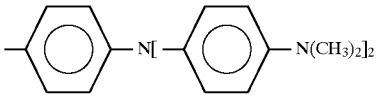 |
| III-84 | 0 | H | 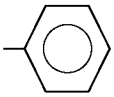 | H | 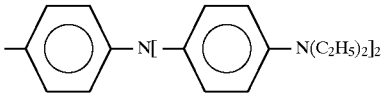 |
| III-85 | 0 | H | 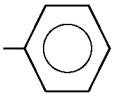 | H | 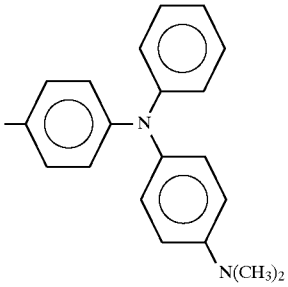 |
| III-86 | 0 | H | 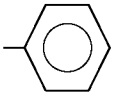 | H | 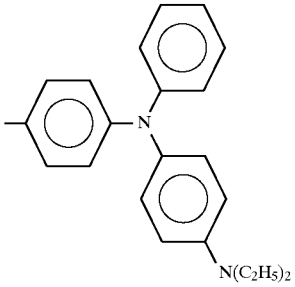 |
| III-87 | 0 | H | 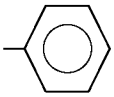 | H | 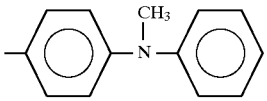 |
| III-88 | 0 | H | 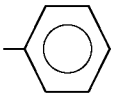 | H | 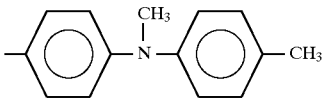 |
| III-89 | 0 | H | 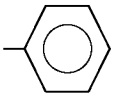 | H | 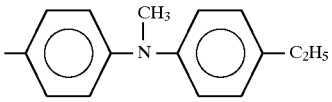 |
| III-90 | 0 | H | 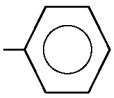 | H | 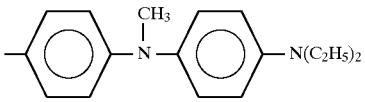 |
| III-91 | 0 | H | 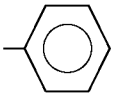 | H | 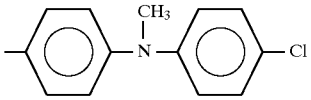 |

TABLE 1-continued
| Charge Transporting Material No. | n | $R^2$ | $R^3$ | $R^4$ | 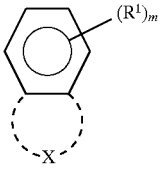 |
|---|---|---|---|---|---|
| III-92 | 0 | H | 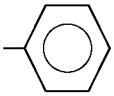 | H | 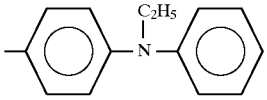 |
| III-93 | 0 | H | 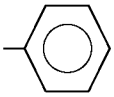 | H | 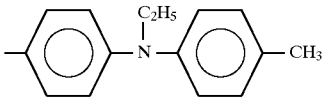 |
| III-94 | 0 | H | 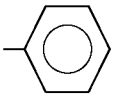 | H | 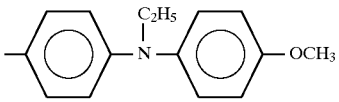 |
| III-95 | 0 | H | 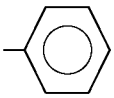 | H | 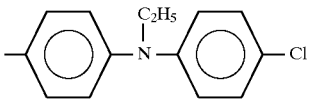 |
| III-96 | 0 | H | 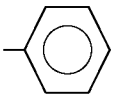 | H | 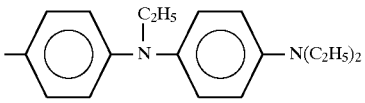 |
| III-97 | 0 | H | 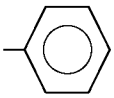 | H | 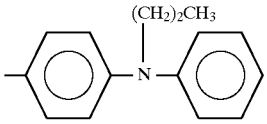 |
| III-98 | 0 | H | 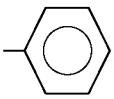 | H | 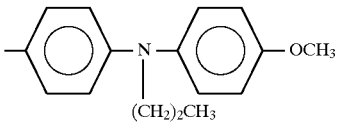 |
| III-99 | 0 | H | 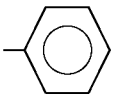 | H | 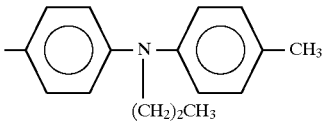 |
| III-100 | 0 | H | 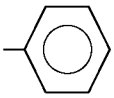 | H | 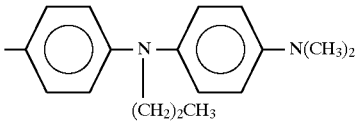 |
| III-101 | 0 | H | 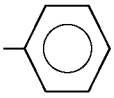 | H | 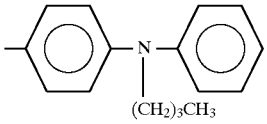 |
| III-102 | 0 | H | 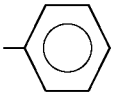 | H | 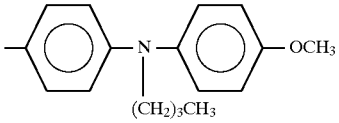 |

TABLE 1-continued
| Charge Transporting Material No. | n | $R^2$ | $R^3$ | $R^4$ | 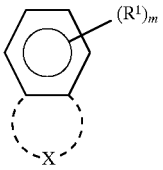 |
|---|---|---|---|---|---|
| III-103 | 0 | H | 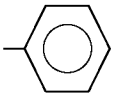 | H | 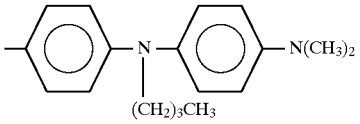 |
| III-104 | 0 | H | 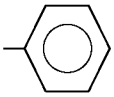 | H | 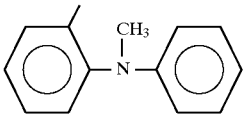 |
| III-105 | 0 | H | 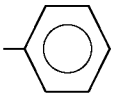 | H | 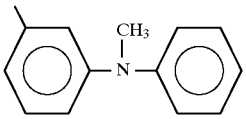 |
| III-106 | 0 | H | 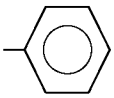 | H | 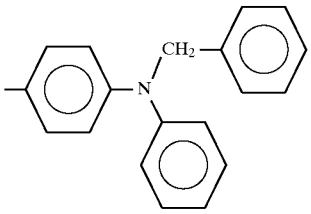 |
| III-107 | 0 | H | 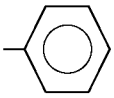 | H | 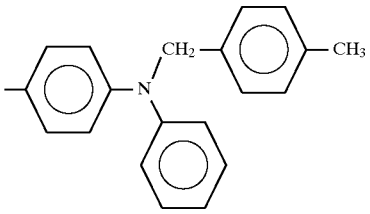 |
| III-108 | 0 | H | 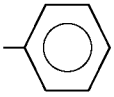 | H | 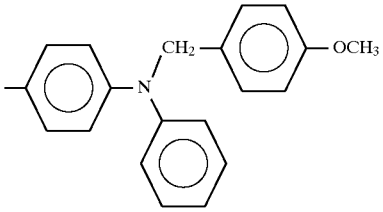 |
| III-109 | 0 | H | 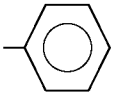 | H | 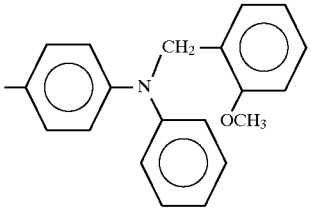 |

TABLE 1-continued
| Charge Transporting Material No. | n | $R^2$ | $R^3$ | $R^4$ | 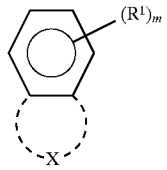 |
|---|---|---|---|---|---|
| III-110 | 0 | H | 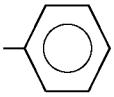 | H | 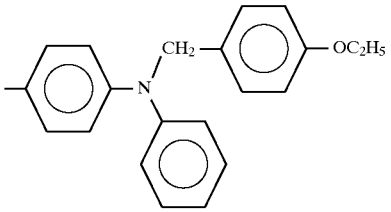 |
| III-111 | 0 | H | 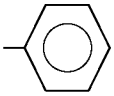 | H | 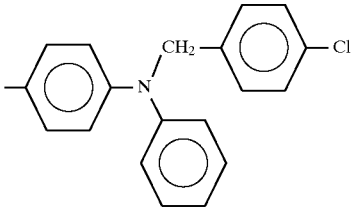 |
| III-112 | 0 | H | 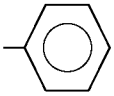 | H | 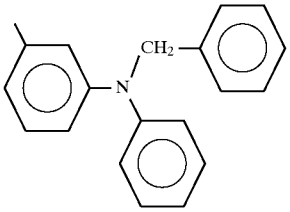 |
| III-113 | 0 | H | 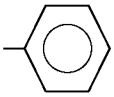 | H | 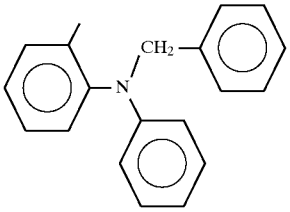 |
| III-114 | 0 | H | 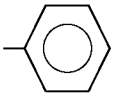 | H | 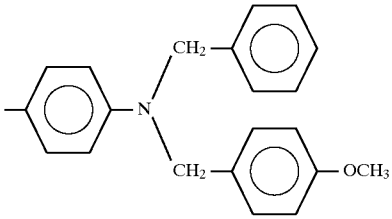 |
| III-115 | 0 | H | 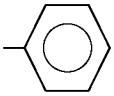 | H | 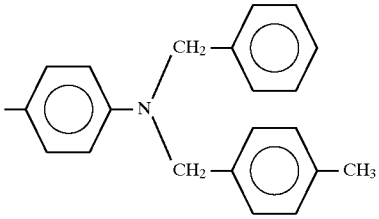 |
| III-116 | 0 | H | 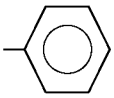 | H | 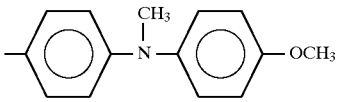 |

TABLE 1-continued
| Charge Transporting Material No. | n | $R^2$ | $R^3$ | $R^4$ | 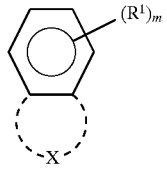 |
|---|---|---|---|---|---|
| III-117 | 0 | H | 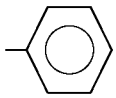 | H | 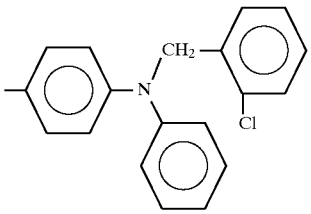 |
| III-118 | 0 | H | 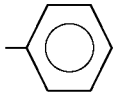 | H | 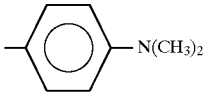 |
| III-119 | 0 | H | 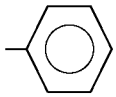 | H | 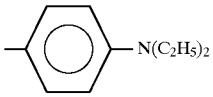 |
| III-120 | 0 | H | 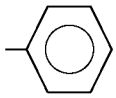 | H | 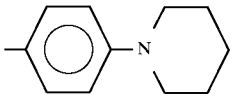 |
| III-121 | 0 | H | 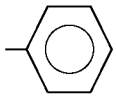 | H | 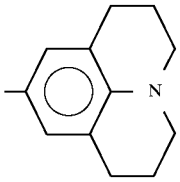 |
| III-122 | 1 | H | 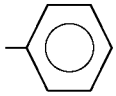 | H | 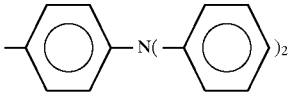 |
| III-123 | 1 | H | 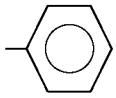 | H | 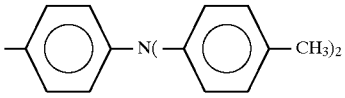 |
| III-124 | 0 | H | H | $CH_3$ | 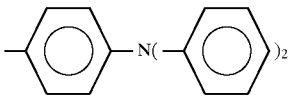 |
| III-125 | 0 | H | H | H | 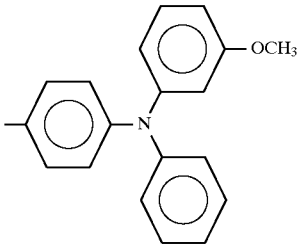 |

TABLE 1-continued

| Charge Transporting Material No. | n | $R^2$ | $R^3$ | $R^4$ | 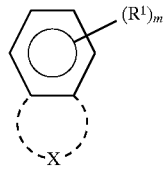 |
|---|---|---|---|---|---|
| III-126 | 0 | H | H | $OCH_3$ | 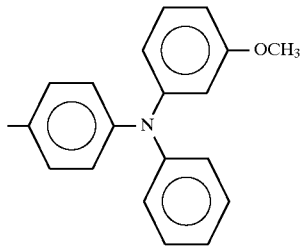 |
| III-127 | 0 | H | H | $CH_3$ | 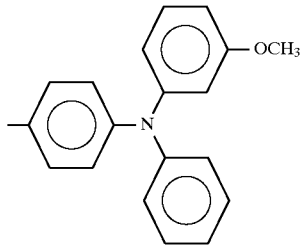 |
| III-128 | 0 | H | 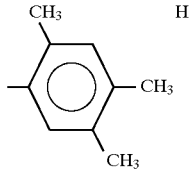 | H | 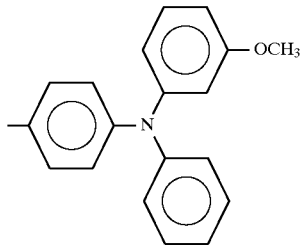 |

In addition, positive-hole-transporting materials and electron-transporting materials can also be employed as the charge transporting materials in the present invention.

Examples of the positive hole transporting materials are as follows:

(IV)

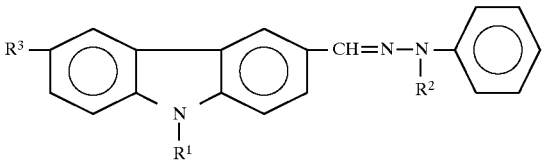

wherein $R^1$ is methyl group, ethyl group, 2-hydroxyethyl group, or 2-chloroethyl group; $R^2$ is methyl group, ethyl group, benzyl group or phenyl group; and $R^3$ is hydrogen, chlorine, bromine, an alkyl group having 1 to 4 carbon atoms, an alkoxyl group having 1 to 4 carbon atoms, a dialkylamino group, or nitro group.

(V)

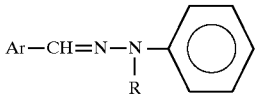

wherein Ar is a naphthyl group, an anthryl group, a styryl group, each of which may have a substituent, a pyridyl group, a furanyl group, or a thiophenyl group; and R is an alkyl group or benzyl group.

(VI)

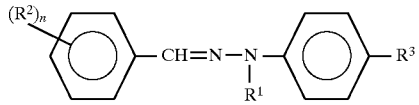

wherein $R^1$ is an alkyl group, benzyl group, phenyl group, or naphthyl group; $R^2$ is hydrogen, an alkyl group having 1 to 3 carbon atoms, an alkoxyl group having 1 to 3 carbon atoms, a dialkylamino group, a diaralkylamino group or a diarylamino group; n is an integer of 1 to 4; when n is 2 or more, $R^2$ may be the same or different; and $R^3$ is hydrogen or methoxy group.

(VII)

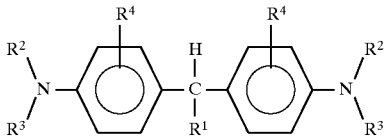

wherein $R^1$ is an alkyl group having 1 to 11 carbon atoms, a substituted or unsubstituted phenyl group, or a heterocyclic ring; $R^2$ and $R^3$, which may be the same or different, each is hydrogen, an alkyl group having 1 to 4 carbon atoms, a hydroxyalkyl group, a chloroalkyl group, or a substituted or unsubstituted aralkyl group, and $R^2$ and $R^3$ in combination may form a heterocyclic ring containing nitrogen; and $R^4$ which may be the same or different, is hydrogen, an alkyl group having 1 to 4 carbon atoms, an alkoxyl group or a halogen.

(VIII)

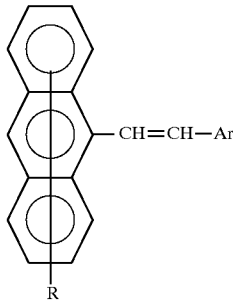

wherein R is hydrogen or a halogen; Ar is phenyl group, naphthyl group, anthryl group or carbazolyl group, each of which may have a substituent.

(IX)

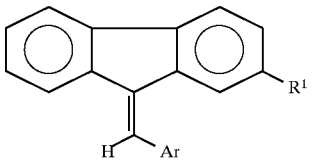

wherein $R^1$ is hydrogen, a halogen, cyano group, an alkoxyl group having 1 to 4 carbon atoms, or an alkyl group having 1 to 4 carbon atoms; Ar is

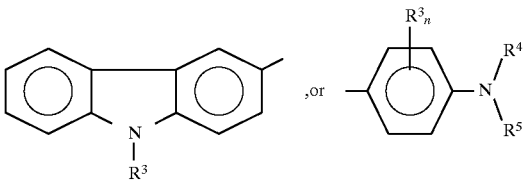

wherein $R^1$ is an alkyl group having 1 to 4 carbon atoms; $R^2$ and $R^3$ each is hydrogen, a halogen, an alkyl group having 1 to 4 carbon atoms, an alkoxyl group having 1 to 4 carbon atoms, or a dialkylamino group; n is an integer of 1 or 2, and when n is 2, $R^3$ may be the same or different; and $R^4$ and $R^5$ each is hydrogen, a substituted or unsubstituted alkyl group having 1 to 4 carbon atoms or a substituted or unsubstituted benzyl group.

(X)

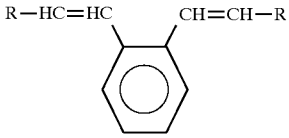

wherein R is carbazolyl group, pyridyl group, thienyl group, indolyl group, furyl group, or a substituted or unsubstituted phenyl group, styryl group, naphthyl group or anthryl group, each of which may have a substituent selected from the group consisting of a dialkylamino group, an alkyl group, an alkoxyl group, carboxyl group or an ester group thereof, a halogen, cyano group, an aralkylamino group, an N-alkyl-N-aralkylamino group, amino group, nitro group and acetylamino group.

(XI)

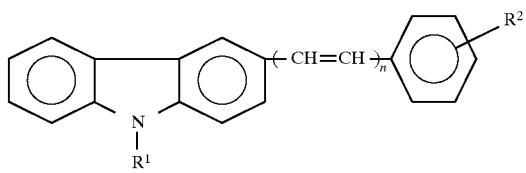

wherein $R^1$ is a lower alkyl group, benzyl group or a substituted or unsubstituted aryl group; $R^2$ is hydrogen, a lower alkyl group, a lower alkoxyl group, a halogen, nitro group, amino group which may have as a substituent a lower alkyl group or benzyl group; and n is an integer of 1 or 2.

(XII)

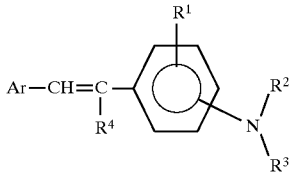

wherein $R^1$ is hydrogen, an alkyl group, an alkoxyl group or a halogen; $R^2$ and $R^3$ each is an alkyl group, a substituted or unsubstituted aralkyl group or a substituted or unsubstituted aryl group; $R^4$ is hydrogen, or a substituted or unsubstituted phenyl group; and Ar is phenyl group or naphthyl group.

(XIII)

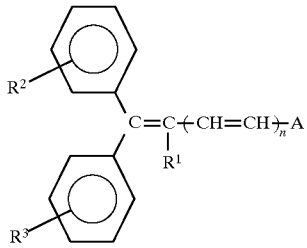

wherein n is an integer of 0 or 1; $R^1$, $R^2$ and $R^3$ each is hydrogen, an alkyl group or a substituted or unsubstituted phenyl group;

A represents

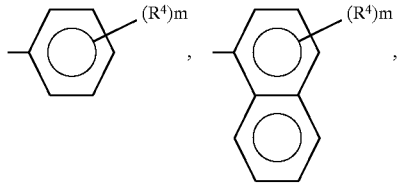

9-anthryl group or a substituted or unsubstituted N-alkylcarbazolyl group, in which $R^4$ is hydrogen, an alkyl group, an alkoxyl group, a halogen, or

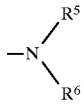

in which $R^5$ and $R^6$, which may form a ring in combination, each is a substituted or unsubstituted aralkyl group, or a substituted or unsubstituted aryl group; m is an integer of 0 to 3, and when m is 2 or more, $R^4$ may be the same or different.

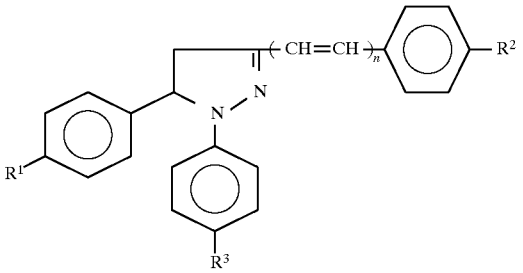

(XIV)

wherein $R^1$, $R^2$ and $R^3$ each is hydrogen, a lower alkyl group, a lower alkoxyl group, a dialkylamino group or a halogen; and n is an integer of 0 or 1.

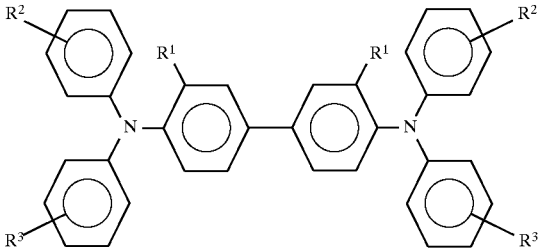

(XV)

wherein $R^1$, $R_2$ and $R^3$ each is hydrogen, an alkyl group, an alkoxyl group or a halogen, and $R^2$ and $R^3$ may be the same or different.

Specific examples of the compound of formula (IV) 9-ethylcarbazole-3-aldehyde-1-methyl-1-phenylhydrazone, 9-ethylcarbazole-3-aldehyde-1-benzyl-1-phenylhydrazone, and 9-ethylcarbazole-3-aldehyde-1,1-diphenylhydrazone.

Specific examples of the compound of formula (V) are 4-diethylaminostyrene-β-aldehyde-1-methyl-1-phenylhydrazone, and 4-methoxynaphthalene-1-aldehyde-1-benzyl-1-phenylhydrazone.

Specific examples of the compound of formula (VI) are 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-benzyl-1-(4-methoxy) phenylhydrazone, 4-diphenylaminobenzaldehyde-1-benzyl-1-phenylhydrazone, and 4-dibenzylaminobenzaldehyde-1,1-diphenylhydrazone.

Specific examples of the compound of formula (VII) are 1,1-bis(4-dibenzylaminophenyl)propane, tris(4-diethylaminophenyl)methane, 1,1-bis(4-dibenzylaminophenyl)propane, and 2,2'-dimethyl-4,4'-bis (diethylamino)-triphenylmethane.

Specific examples of the compound of formula (VIII) are 9-(4-diethylaminostyryl)anthracene, and 9-bromo-10-(4-diethylaminostyryl)anthracene.

Specific examples of the compound of formula (IX) are 9-(4-dimethylaminobenzylidene)fluorene, and 3-(9-fluorenylidene)-9-ethylcarbazole.

Specific examples of the compound of formula (X) are 1,2-bis(4-diethylaminostyryl)benzene, and 1,2-bis(2,4-dimethoxystyryl)benzene.

Specific examples of the compound of formula (XI) are 3-styryl-9-ethylcarbazole, and 3-(4-methoxystyryl)-9-ethylcarbazole.

Specific examples of the compound of formula (XII) are 4-diphenylaminostilbene, 4-dibenzylaminostilbene, 4-ditolylaminostilbene, 1-(4-diphenylaminostyryl) naphthalene, and 1-(4-diethylaminostyryl)naphthylene.

Specific examples of the compound of formula (XIII) are 4'-diphenylamino-α-phenylstilbene, and 4'-methylphenylamino-α-phenylstilbene.

Specific examples of the compound of formula (XIV) are 1-phenyl-3-(4-diethylaminostyryl)-5-(4-diethylaminophenyl)pyrazoline, and 1-phenyl-3-(4-dimethylaminostyryl)-5-(4-dimethylaminophenyl) pyrazoline.

Specific examples of the compound of formula (XV) are N,N'-diphenyl-N,N'-bis(3-methylphenyl)-[1,1'-bisphenyl]-4,4'-diamine, N,N'-diphenyl-N,N'-bis(chlorophenyl)-[1,1'-biphenyl]-4,4'-diamine, and 3,3'-dimethylbenzidine.

Examples of other positive hole transporting materials are low-molecular compounds, for example, oxadiazole compounds such as 2,5-bis(4-diethylaminophenyl)-1,3,4-oxadiazole, 2,5-bis[4-(4-diethylaminostyryl)phenyl]-1,3,4-oxadiazole, and 2-(9-ethylcarbazolyl-3-)-5-(4-diethylaminophenyl)-1,3,4-oxadiazole, and oxazole compounds such as 2-vinyl-4-(2-chlorophenyl)-5-(4-diethylaminophenyl)oxazole, and 2-(4-diethylaminophenyl)-4-phenyloxazole; and polymers such as poly-N-vinylcarbazole, halogenated poly-N-vinylcarbazole, polyvinylpyrene, polyvinylanthracene, pyrene formaldehyde resin and ethylcarbazole formaldehyde resin.

Specific examples of other charge transporting materials are chloroanil, bromoanil, tetracyanoethylene, tetracyanoquinone dimethane, 2,4,7-trinitro-9-fluorenone, 2,4,5,7-tetranitro-9-fluorenone, 2,4,5,7-tetranitroxanthone, 2,4,8-trinitrothioxanthone, and 2,6,8-trinitro-4H-indeno[1,2-b] thiophene-4-one, 1,3,7-trinitrodibenzothiophene-5,5-dioxide.

Other features of this invention will become apparent in the course of the following description of exemplary embodiments, which are given for illustration of the invention and are not intended to be limiting thereof.

EXAMPLE 1

Salt Milling of Azo Pigment

A mixture of 1 g of an azo pigment (P-1) of the following formula (1) and 40 g of NaCl was subjected to ball milling together with 100 g of 5 mm diameter PSZ balls in a 50 ml glass vessel for five days.

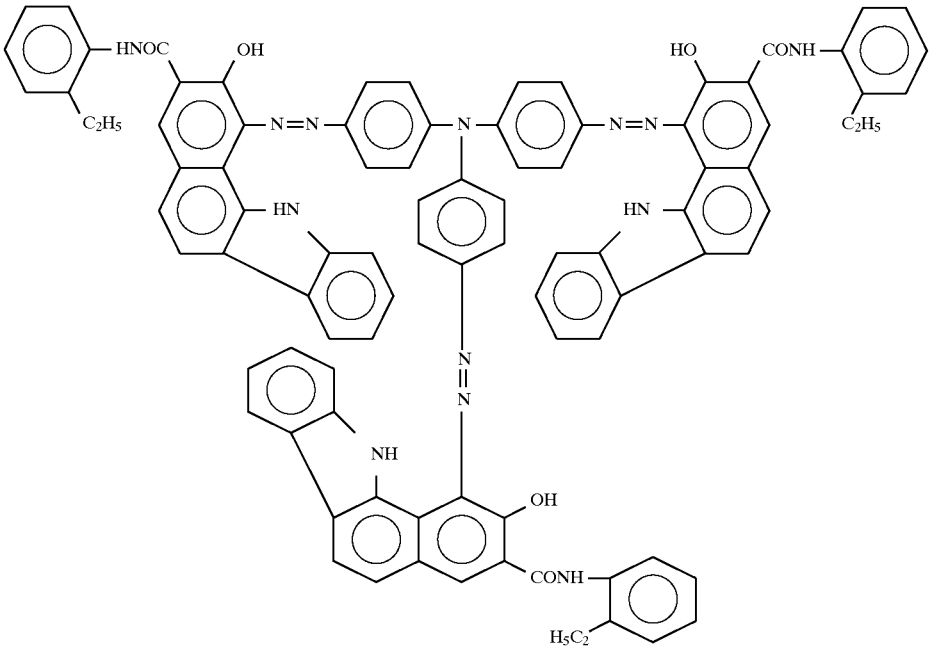

(1)

Thereafter, 100 ml of ion exchange water were added to the above mixture to dissolve NaCl therein. The resulting dispersion of the azo pigment was taken out of the glass vessel and filtered through a paper filter. Furthermore, the azo pigment was washed by dissolving the residual NaCl in 900 ml of ion exchange water. The azo pigment thus obtained was dried at 120° C. under reduced pressure for 5 days.

The azo pigment thus obtained by subjecting the azo pigment P-1 to the salt milling process is referred to as the azo pigment SP-1. FIGS. 1A and 1B are graphs respectively showing the X-ray diffraction patterns of the azo pigment SP-1, and the azo pigment P-1.

Formation of Charge Generation Layer 0.25 g of the above prepared azo pigment SP-1, 5.0 g of a 2% cyclohexanone solution of a polyvinyl butyral resin (Trademark "XYHL", made by Union Carbide Japan K.K.), and 7 g of cyclohexanone were placed in a 50 ml glass vessel and the mixture was subjected to ball milling together with 100 g of 5 mm diameter PSZ balls for five days. With the addition of 10 g of cyclohexanone, the above mixture was further subjected to ball milling for one day, so that a coating liquid for a charge generation layer was obtained.

The charge generation layer coating liquid thus obtained was coated on an aluminum surface of an aluminum-deposited polyester film with a thickness of 75 $\mu$m serving as an electroconductive support by using a stainless-steel doctor blade with a gap of 30 $\mu$m, and then dried at 80° C. for 3 minutes, so that a charge generation layer was provided on the electroconductive support.

Formation of Charge Transport Layer 10 g of a Z type polycarbonate resin (Trademark "PCX5", made by Teijin Limited.), 8 g of $\alpha$-phenylstilbene compound (i) of the following formula (2) and 72 g of toluene were mixed to prepare a coating liquid for a charge transport layer:

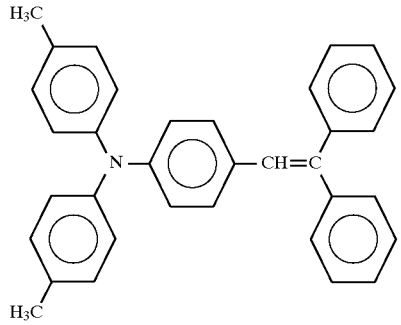

(2)

The charge transport layer coating liquid thus prepared was coated on the above prepared charge generation layer by a blade, and dried at 80° C. for 2 minutes, and then at 130° C. for 5 minutes, so that a transport layer with a thickness of about 20 $\mu$m was provided on the charge generation layer.

Thus, an electrophotographic photoconductor No. 1 according to the present invention was obtained.

EXAMPLE 2

The procedure for preparation of the electrophotographic photoconductor No. 1 according to the present invention in Example 1 was repeated except that $\alpha$-phenylstilbene compound (i) for use in the charge transport layer coating liquid for the photoconductor No. 1 in Example 1 was replaced by $\alpha$-phenylstilbene compound (ii) of the following formula (3):

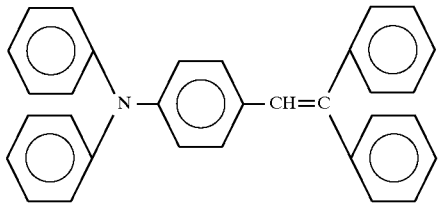

(3)

Thus, an electrophotographic photoconductor No. 2 according to the present invention was obtained.

Comparative Example 1

The procedure for preparation of the electrophotographic photoconductor No. 1 according to the present invention in Example 1 was repeated except that the azo pigment SP-1 subjected to the salt milling process for use in the charge generation layer coating liquid for the photoconductor No. 1 in Example 1 was replaced by the azo pigment P-1 not subjected to the salt milling process, so that a comparative electrophotographic photoconductor No. 1 was obtained.

Comparative Example 2

The procedure for preparation of the electrophotographic photoconductor No. 2 according to the present invention in Example 2 was repeated except that the azo pigment SP-1 subjected to the salt milling process for use in the charge generation layer coating liquid for the photoconductor No. 2 in Example 2 was replaced by the azo pigment P-1 not subjected to the salt milling process, so that a comparative electrophotographic photoconductor No. 2 was obtained.

Each of the above prepared electrophotographic photoconductors No. 1 and No. 2 according to the present invention and comparative electrophotographic photoconductors No. 1 and No. 2 was negatively charged in the dark under application of −5.5 kV for 2 seconds, using a commercially available electrostatic properties measuring instrument "EPA8100" (Trademark), made by Kawaguchi Electro Works Co., Ltd. The charging potential $V_2$ (V) of each photoconductor was measured.

In addition, to evaluate the photosensitivity to the white light, each photoconductor was charged in the dark to obtain the initial surface potential of −800 V. The photoconductor was then illuminated by a tungsten lamp with a color temperature of 2856 K in such a manner that the illuminance of the illuminated surface of the photoconductor was 4.5 lux, and the exposure $E_{1/10}$ (lux·sec) required to reduce the initial surface potential −800 V to 1/10 the initial surface potential, that is, −80 V, was measured.

Furthermore, to evaluate the photosensitivity to the light of 780 nm, each of the photoconductor was irradiated by the light of 780 nm with a half-width of 20 nm obtained by passing through a band pass filter. The exposure $E_{1/10}$ ($\mu J/cm^2$) required to reduce the initial surface potential −800 V to 1/10 the initial surface potential, that is, −80 V, was measured.

The results are shown in Table 2.

TABLE 2

| | $V_2$ (V) | $E_{1/10}$ (lux · sec) | $E'_{1/10}$ ($\mu J/cm^2$) |
|---|---|---|---|
| Ex. 1 | −800 | 0.60 | 0.55 |
| Comp. Ex. 1 | −769 | 1.15 | 1.01 |
| Ex. 2 | −880 | 0.74 | 0.65 |
| Comp. Ex. 2 | −835 | 2.16 | 1.88 |

Figure 2:
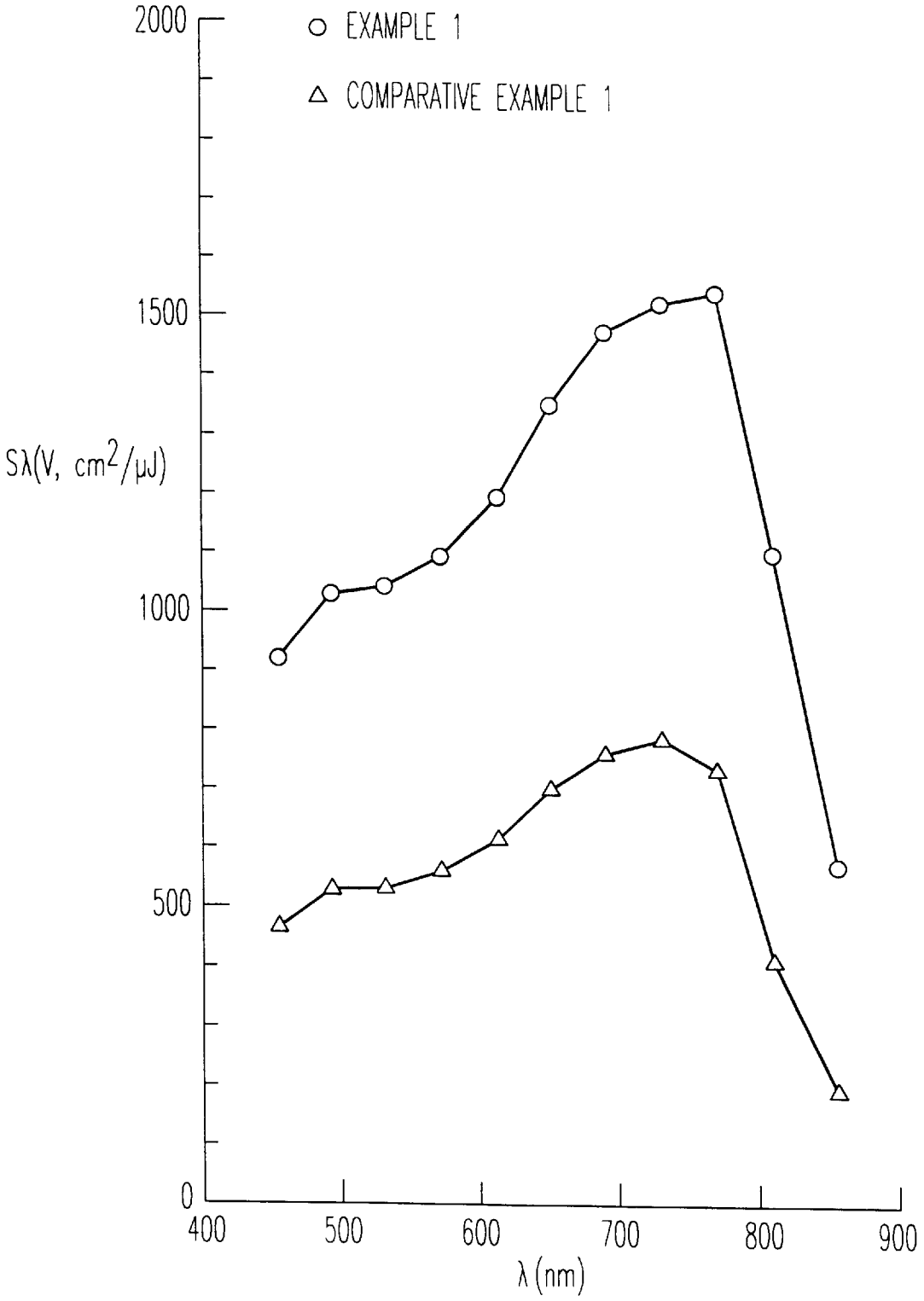
FIG. 2 is a graph which shows the spectral sensitivities of electrophotographic photoconductors obtained in Example 1 and Comparative Example 1.

The spectral sensitivities of the photoconductor No. 1 according to the present invention and the comparative photoconductor No. 1 are shown in FIG. 2. As is apparent from the graph shown in FIG. 2, the photosensitivity of the photoconductor No. 1 according to the present invention is increased twice that of the comparative photoconductor No. 1 from the visible region to the near infrared region.

EXAMPLE 3

The procedure for preparation of the electrophotographic photoconductor No. 1 according to the present invention in Example 1 was repeated except that the azo pigment SP-1 for use in the charge generation layer coating liquid for the photoconductor No. 1 in Example 1 was replaced by an azo pigment SP-2 which was obtained by subjecting an azo pigment P-2 of the following formula (4) to the salt milling process by the same method as in Example 1, so that an electrophotographic photoconductor No. 3 according to the present invention was obtained.

[Azo pigment P-2] (4)

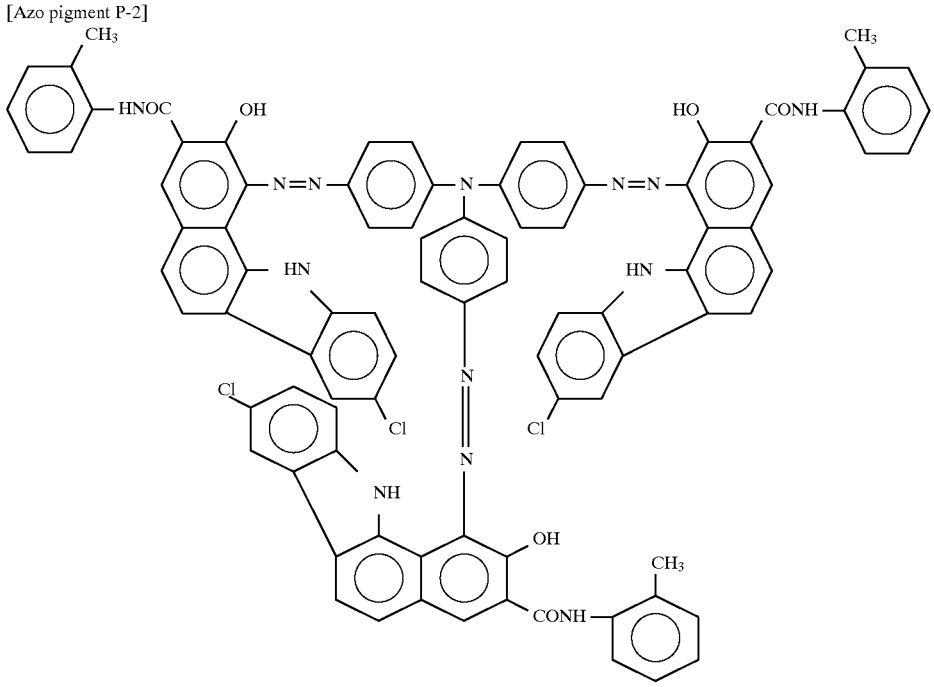

Using the above prepared photoconductor No. 3 according to the present invention, the charging potential $V_2$, and the photosensitivities to the white light and the near infrared light of 780 nm were measured in the same manner as in Example 1. The results are shown in Table 3.

Comparative Example 3

The procedure for preparation of the comparative electrophotographic photoconductor No. 1 in Comparative Example 1 was repeated except that the azo pigment P-1 not subjected to the salt milling process for use in the charge generation layer coating liquid for the comparative photoconductor No. 1 in Comparative Example 1 was replaced by the azo pigment P-2 not subjected to the salt milling process, so that a comparative electrophotographic photoconductor No. 3 was obtained.

Using the above prepared comparative photoconductor No. 3, the charging potential $V_2$, and the photosensitivities to the white light and the near infrared light of 780 nm were measured in the same manner as in Example 1. The results are shown in Table 3.

EXAMPLE 4

The procedure for preparation of the electrophotographic photoconductor No. 1 according to the present invention in Example 1 was repeated except that the azo pigment SP-1 for use in the charge generation layer coating liquid for the photoconductor No. 1 in Example 1 was replaced by an azo pigment SP-3 which was obtained by subjecting an azo pigment P-3 of the following formula (5) to the salt milling process by the same method as in Example 1, so that an electrophotographic photoconductor No. 4 according to the present invention was obtained.

[Azo pigment P-3] (5)

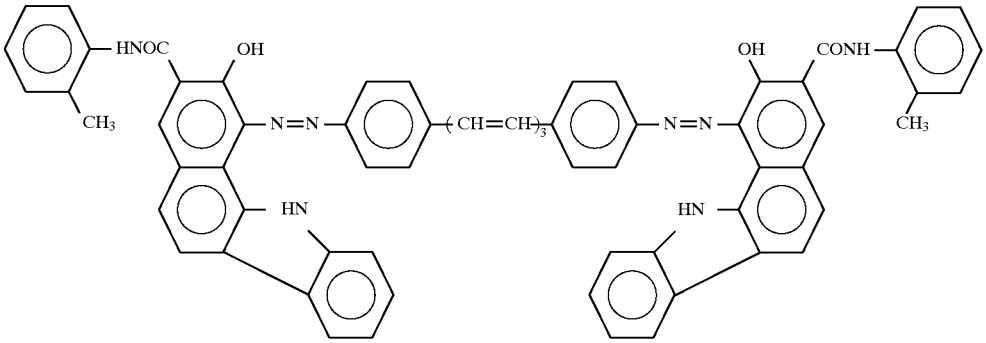

Using the above prepared photoconductor No. 4 according to the present invention, the charging potential $V_2$, and the photosensitivities to the white light and the near infrared light of 780 nm were measured in the same manner as in Example 1. The results are shown in Table 3.

Comparative Example 4

The procedure for preparation of the comparative electrophotographic photoconductor No. 1 in Comparative Example 1 was repeated except that the azo pigment P-1 not subjected to the salt milling process for use in the charge generation layer coating liquid for the comparative photoconductor No. 1 in Comparative Example 1 was replaced by the azo pigment P-3 not subjected to the salt milling process, so that a comparative electrophotographic photoconductor No. 4 was obtained.

Using the above prepared comparative photoconductor No. 4, the charging potential $V_2$, and the photosensitivities to the white light and the near infrared light of 780 nm were measured in the same manner as in Example 1. The results are shown in Table 3.

TABLE 3

| | $V_2$ (V) | $E_{1/10}$ (lux · sec) | $E'_{1/10}$ ($\mu$J/cm$^2$) |
|---|---|---|---|
| Ex. 3 | −800 | 1.60 | 1.55 |
| Comp. Ex. 3 | −769 | 4.67 | 4.06 |
| Ex. 4 | −880 | 2.20 | — |
| Comp. Ex. 4 | −835 | 6.20 | — |

EXAMPLE 5

Formation of Intermediate Layer

An alcohol-soluble polyamide resin (Trademark "Amilan CM8000", made by Toray Industries, Inc.) was coated on an aluminum surface of an aluminum-deposited polyester film with a thickness of 75 $\mu$m serving as an electroconductive support, so that an intermediate layer with a thickness of 0.3 $\mu$m was provided on the electroconductive support.

Formation of Photoconductive Layer

A mixture of 2.5 g of the azo pigment (SP-1) which was obtained by subjecting the azo pigment (P-1) to the salt milling process in the same manner as in Example 1, and 30 g of cyclohexanone was subjected to ball milling together with agate balls in a glass vessel for three days. Thus, a dispersion A containing the azo pigment SP-1 was obtained.

5 g of a polycarbonate resin (Trademark "C-1400", made by Teijin Limited.), 5 g of the α-phenylstilbene compound (i) of formula (2), 0.05 g of 2,5-di-tert-butyl hydroquinone, 15 g of the above prepared dispersion A of the azo pigment SP-1, and 30 g of tetrahydrofuran were mixed to prepare a coating liquid for a photoconductive layer.

The photoconductive layer coating liquid thus prepared was coated on the above prepared intermediate layer by using a doctor blade with a gap of 250 $\mu$m, and dried at 80° C. for 5 minutes and then at 120° C. for one hour, so that a photoconductive layer with a thickness of about 20 $\mu$m was provided on the intermediate layer.

Thus, an electrophotographic photoconductor No. 5 according to the present invention was obtained.

Using the above prepared photoconductor No. 5 according to the present invention, the charging potential ($V_2$), and the photosensitivity ($E'_{1/10}$) to the near infrared light of 780 nm were measured in the same manner as in Example 1. The results are as follows:

$V_2$=−850 V, and $E'_{1/10}$=0.68 μJ/cm$^2$.

Comparative Example 5

The procedure for preparation of the electrophotographic photoconductor No. 5 according to the present invention in Example 5 was repeated except that the azo pigment SP-1 in the dispersion A used for the photoconductive layer coating liquid for the photoconductor No. 5 in Example 5 was replaced by the azo pigment P-1 of formula (1) not subjected to the salt milling process, so that a comparative electrophotographic photoconductor No. 5 was obtained.

Using the above prepared comparative photoconductor No. 5, the charging potential ($V_2$), and the photosensitivity ($E'_{1/10}$) to the near infrared light of 780 nm were measured in the same manner as in Example 1. The results are as follows:

$V_2$=−700 V, and $E'_{1/10}$=1.50 μJ/cm$^2$.

EXAMPLE 6

Salt Milling of Azo Pigment

A mixture of 1 g of the azo pigment (P-1) of formula (1), 20 g of NaCl and 20 g of cyclohexanone was subjected to ball milling together with 100 g of 5 mm diameter PSZ balls in a 50 ml glass vessel for five days.

Thereafter, with the addition of 50 ml of methyl ethyl ketone, the above mixture of the azo pigment and NaCl was taken out of the glass vessel and the solvent component was removed from the mixture by filtration. Furthermore, the azo pigment was washed by dissolving the residual NaCl in 500 ml of ion exchange water. The azo pigment thus obtained was dried at 120° C. under reduced pressure for 5 days.

The azo pigment thus obtained by subjecting the azo pigment P-1 to the solvent salt milling process is referred to as the azo pigment SSP-1.

Formation of Electrophotographic Photoconductor

The procedure for preparation of the electrophotographic photoconductor No. 1 according to the present invention in Example 1 was repeated except that the azo pigment SP-1 for use in the charge generation layer coating liquid for the photoconductor No. 1 in Example 1 was replaced by the above prepared azo pigment SSP-1 subjected to the solvent salt milling process, so that an electrophotographic photoconductor No. 5 according to the present invention was obtained.

Using the above prepared photoconductor No. 5 according to the present invention, the charging potential $V_2$, the photosensitivity $E_{1/10}$ (lux·sec) to the white light, and the photosensitivity $E'_{1/10}$ (μJ/cm$^2$) to the near infrared light of 780 nm were measured in the same manner as in Example 1. The results are as follows:

$V_2$=−929 V, $E_{1/10}$=0.52 lux·sec, and $E'_{1/10}$=0.45 μJ/cm$^2$.

It was confirmed from the above obtained results and the results in Example 1 that the sensitizing effect on the azo pigment for use in the present invention can be further improved by the solvent salt milling process as compared with the dry-type salt milling process.

EXAMPLES 7 to 16

The procedure for preparation of the electrophotographic photoconductor No. 1 according to the present invention in Example 1 was repeated except that NaCl which was used as a salt in the salt milling process for the azo pigment P-1 in Example 1 was replaced by the respective salts as shown in Table 4.

Thus, electrophotographic photoconductors No. 7 to No. 16 according to the present invention were obtained.

Using each of the above prepared photoconductors Nos. 7 to 16 according to the present invention, the charging potential ($V_2$), and the photosensitivity ($E_{1/10}$) to the white light and the photosensitivity ($E'_{1/10}$) to the near infrared light of 780 nm were measured in the same manner as in Example 1. The results are shown in Table 4.

TABLE 4

| | Salt Used in Salt Milling Process | $V_2$ (V) | $E_{1/10}$ (lux · sec) | $E'_{1/10}$ (μJ/cm$^2$) |
|---|---|---|---|---|
| Ex. 7 | $Na_2CO_3$ | −800 | 0.62 | 0.57 |
| Ex. 8 | $NaHSO_3$ | −820 | 0.62 | 0.57 |
| Ex. 9 | $NaNO_3$ | −825 | 0.53 | 0.48 |
| Ex. 10 | $Na_2B_4O_7.10H_2O$ | −820 | 0.68 | 0.62 |
| Ex. 11 | $NaPO_4.12H_2O$ | −800 | 0.63 | 0.57 |
| Ex. 12 | $K_2SO_4$ | −830 | 0.54 | 0.49 |
| Ex. 13 | KBr | −800 | 0.49 | 0.45 |
| Ex. 14 | NaI | −800 | 0.57 | 0.52 |
| Ex. 15 | KI | −800 | 0.57 | 0.52 |
| Ex. 16 | $CH_3COONa$ | −800 | 0.72 | 0.66 |

As previously explained, the photosensitivity of the electrophotographic photoconductor according to the present invention is remarkably improved in a broad photosensitive wavelength range from visible through near infrared, and the charging characteristics are stable.

What is claimed is:

1. An electrophotographic photoconductor comprising an electroconductive support and a photoconductive layer formed thereon which comprises as a charge generating material an azo pigment subjected to a salt milling process, wherein said azo pigment is a member selected from the group consisting of trisazo pigments represented by formula (I) and bisazo pigments represented by formula (II),

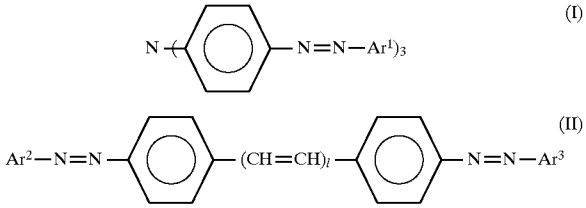

(I)

(II)

wherein $Ar^1$, $Ar^2$ and $Ar^3$ are each independently a coupler residual group and 1 is an integer of 1 to 6.

2. The electrophotographic photoconductor as claimed in claim 1, wherein said azo pigment is a trisazo pigment.

3. The electrophotographic photoconductor as claimed in claim 1, wherein said azo pigment is a bisazo pigment.

4. The electrophotographic photoconductor as claimed in claim 1, wherein said photoconductive layer comprises a charge generation layer and a charge transport layer.

5. The electrophotographic photoconductor as claimed in claim 1, wherein said salt milling process is a dry process using an inorganic salt or an organic salt.

6. The electrophotographic photoconductor as claimed in claim 5, wherein said inorganic salt is selected from the group consisting of an alkali metal halide, carbonate, sulfate and phosphate.

7. The electrophotographic photoconductor as claimed in claim 6, wherein said inorganic salt is selected from the group consisting of NaCl, $Na_2CO_3$, $NaHSO_3$, $NaNO_3$, $Na_2B_4O_7$, $NaPO_4$, NaI, $Na_2SO_4$, KCl, KBr, $K_2SO_4$, and $CaCO_3$.

8. The electrophotographic photoconductor as claimed in claim 5, wherein said organic salt is $CH_3COONa$.

9. The electrophotographic photoconductor as claimed in claim 5, wherein said inorganic salt or said organic salt has a cation of $Na^+$ or $K^+$.

10. The electrophotographic photoconductor as claimed in claim 1, wherein said salt milling process is a wet process using an inorganic salt or an organic salt, and an organic solvent in which said inorganic salt or said organic salt is slightly soluble.

11. The electrophotographic photoconductor as claimed in claim 10, wherein said inorganic salt is selected from the group consisting of an alkali metal halide, carbonate, sulfate and phosphate.

12. The electrophotographic photoconductor as claimed in claim 11, wherein said inorganic salt is selected from the group consisting of NaCl, $Na_2CO_3$, $NaHSO_3$, $NaNO_3$, $Na_2B_4O_7$, $NaPO_4$, NaI, $Na_2SO_4$, KCl, KBr, $K_2SO_4$, and $CaCO_3$.

13. The electrophotographic photoconductor as claimed in claim 10, wherein said organic salt is $CH_3COONa$.

14. The electrophotographic photoconductor as claimed in claim 10, wherein said inorganic salt or said organic salt has a cation of $Na^+$ or $K^+$.

* * * * *

UNITED STATES PATENT AND TRADEMARK OFFICE

CERTIFICATE OF CORRECTION

PATENT NO. : 5,863,683
DATED : January 26, 1999
INVENTOR(S) : Katsuichi Ohta et al.

It is certified that error appears in the above-identified patent and that said Letters Patent is hereby corrected as shown below:

Column 4,
Line 20, "An" should read -- an --.

Column 14,
Line 30, (Figure III) "Cl" should read -- $CH_3$ --.

Column 43,
Line 35, "$E_{1/10}$" should read -- $E_{1/2}$ --.

Column 44,
Line 4, "$E_{1/10}$" should read -- $E_{1/2}$ --.

Signed and Sealed this

Eighth Day of April, 2003

JAMES E. ROGAN
*Director of the United States Patent and Trademark Office*